United States Patent [19]

Rossum

[11] Patent Number: 4,506,579

[45] Date of Patent: Mar. 26, 1985

[54] ELECTRONIC MUSICAL INSTRUMENT

[75] Inventor: David P. Rossum, LaSelva Beach, Calif.

[73] Assignee: E-MU Systems, Inc., Santa Cruz, Calif.

[21] Appl. No.: 485,955

[22] Filed: Apr. 18, 1983

[51] Int. Cl.[3] ..... G10H 1/46; G10H 7/00

[52] U.S. Cl. ..... 84/1.01; 84/1.27

[58] Field of Search ..... 84/1.01, 1.03, 1.27

[56] References Cited

U.S. PATENT DOCUMENTS 4,387,617 6/1983 Kato et al. ..... 84/1.01

*Primary Examiner*—Stanley J. Witkowski

*Attorney, Agent, or Firm*—Flehr, Hohbach, Test, Albritton & Herbert

[57] ABSTRACT

An electronic musical instrument is disclosed. The instrument includes an improved control means for addressing a read only memory (ROM) which stores digital data representing one or more musical sounds. The instrument thereby provides multiple realistic sounds by virtue of the improved control means.

5 Claims, 6 Drawing Figures

ELECTRONIC MUSICAL INSTRUMENT

BACKGROUND OF THE INVENTION

The present invention relates to an electronic musical instrument.

As is known in the prior art, one form of electronic musical instrument stores a digital representation of an analog musical sound such as an organ, a drum, or other type of musical instrument. The sound is typically stored in a read only memory (a "sound" ROM) and the sound ROM is addressed by a counter with the digital representations being serially read out of the memory and connected to a digital to analog converter (DAC). The resulting analog waveform is then connected to an audio output channel and to a conventional audio speaker, whereby the resulting analog sound is an accurate presentation of the digital signal stored in the ROM.

In order to provide for multiple sounds, the prior art approach has typically utilized a separate ROM and separate counter for each sound with the resulting digital signals being transmitted to separate DACs or in a time division multiplex (TDM) format for connection to a single DAC. The resulting analog waveform from the single DAC is then demultiplexed to the appropriate audio channels.

Such prior art approaches are illustrated in U.S. Pat. Nos. 3,763,364 and 4,305,319. A problem with such approaches is that in order to provide for generation a plurality of musical sounds accurately, the equipment is necessarily more complex (and expensive) because of the additional hardware and/or software requirements.

It would be highly desirable to provide an improved electronic musical instrument which would reduce the hardware complexity of the prior art while still providing for faithful reproduction of the desired musical sounds to be played simultaneously.

It is therefore an objective of the present invention to provide an electronic musical instrument which improves on the deficiencies of the prior art as described above.

SUMMARY OF THE INVENTION

In order to achieve the general objective of an improved electronic musical instrument, the present invention includes a first memory which stores, in digital format, a plurality of musical sounds. The digital "sound" data is read out of the first memory in a time division multiplex (TDM) format for connection to a digital to analog converter, which converts those digital TDM representations to an analog format, which are then demultiplexed to a plurality of audio channels.

The present invention also includes a second memory for addressing the first sound memory at address locations corresponding to the particular time sequence in the time division multiplex (TDM) format. The second memory means also includes means for incrementing the address location for each musical sound to a number corresponding to the next address location which contains the next digital word for the respective musical sound contained within the first memory in the TDM format. The second memory also includes means for maintaining the current count of the remaining number of digital words which are required to be read out of the first memory in order for the respective musical sound to be faithfully generated and reproduced.

In another embodiment, the present invention also includes a multiplying digital to analog converter (MDAC) together with a third memory means which includes stored data for adjusting the "level" or intensity of the sound to be reproduced for each audio channel. The level memory means, in conjunction with the MDAC, provides appropriate adjustment to the level of each sound for each of the channels to be reproduced.

In accordance with the foregoing summary, the present invention achieves the objective of providing an improved electronic musical instrument.

Other objects and features of preferred embodiments of the present invention will become apparent from the following detailed description when taken in conjunction with the accompanying drawings.

DESCRIPTION OF THE DRAWINGS

Figure 1:
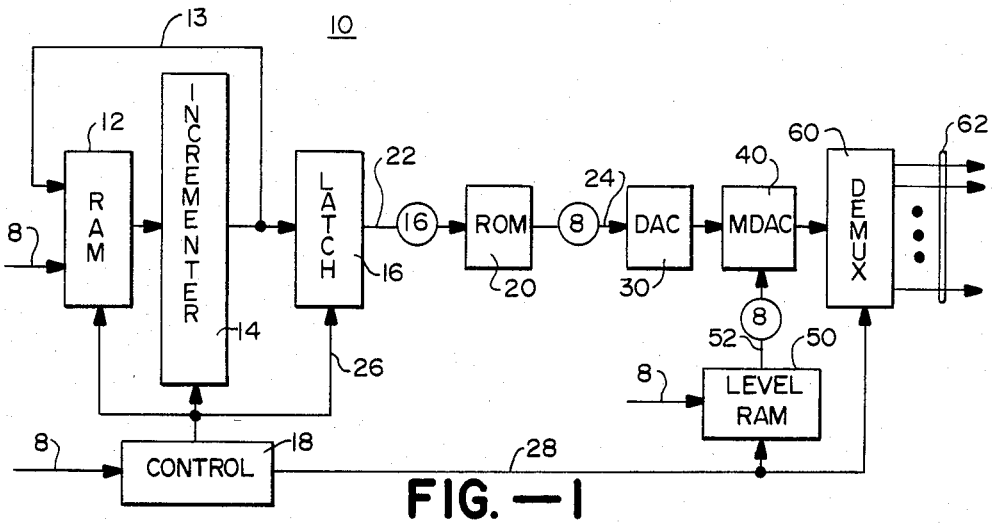
FIG. 1 depicts a block diagram of an electronic musical instrument according to the present invention.

FIG. 1 depicts a block diagram of an electronic musical instrument 10 according to the present invention.

In FIG. 1, a first memory 20 is typically a read only memory (ROM) which stores digital representations of one or more musical sounds. Accurate digital representation of sounds can be achieved by storing a plurality of digital words in a memory such as ROM 20. When ROM 20 is properly addressed, the stored digital words are serially read out of the memory for connection to a digital to analog converter (DAC) 30 which converts the digital words to an analog format for connection to an audio channel thereby completing generation of the desired musical sounds in an analog format.

In FIG. 1, ROM 20 stores, in one preferred embodiment, variations of typical drum sounds which are desired to be reproduced simultaneously, as will be described. However, ROM 20 could store in digital format virtually any type of sound, as desired.

In a preferred embodiment, the present invention utilizes eight audio channels in order to generate simultaneously up to eight different musical sounds. For each musical sound, ROM 20 stores a series of 8-bit digital words. When properly addressed via control signals on memory address bus 22 (a 16-bit address bus), a sequence of 8-bit digital words are written from ROM 20 to 8-bit sound data bus 24 for connection to digital to analog converter (DAC) 30.

Because one aspect of the present invention achieves the generation of simultaneous audio musical sounds on audio channels 62, the present invention operates in a preferred embodiment in a time division multiplex (TDM) format. As will be described, the TDM format is achieved through a control means which, in combination with the other aspects of the present invention, provides an improved electronic musical instrument for generating simultaneously one or more musical sounds.

The aforementioned control means provides appropriate control signals on memory address bus 22 to enable the addressing of ROM 20 in a TDM format so that the stored digital information can be converted to an analog format and then demultiplexed by a multiplexer (DEMUX) 60.

In FIG. 1, the control means includes a random access memory (RAM) 12, incrementer 14 and latch 16, all of which are controlled by control circuit 18.

In order to achieve the simultaneous generation of a plurality of musical sounds, RAM 12 is 16-bit by 16-word memory which stores data typically received from a computer (not shown) via bus 8. RAM 12 stores this "control" digital data for all of the musical sounds to be generated. Specifically, 16 bits of each word of digital data stored in a first location in RAM 12 form the current location of the stored digital data in ROM 20 to be addressed and the other 16 bits of each word stored in a second location in RAM 12 represent the remaining size "count" of the particular channel representing the musical sound. Each musical sound can be represented by a series of digital data words, which when read out sequentially from a memory such as ROM 20, form in digital format a complete musical sound. The control "count" in RAM 12 represents, for each musical sound, the remaining number of bytes of data to be read out of ROM 20 in order to complete the generation of the desired musical sound.

Hence, RAM 12 stores for each of the audio channels (or each musical sound) digital control data representing the current location to actually be addressed in ROM 20 and the remaining size count in order for that particular musical sound to be generated.

The particular digital data initially stored in RAM 12 is typically provided via a computer (not shown) on bus 8. The particular aspects of storing the digital data would be clear to one skilled in the art and for simplicity purposes is therefore not shown in detail. However, it should be understood that the digital data representation can be easily provided from any conventional computer or other control means for storage in RAM 12.

Another part of the overall control means for addressing ROM 20 in FIG. 1 is incrementer 14. The general function of incrementer 14 is to increment the "address count" in RAM 12 which represents the next location in ROM 20 to be addressed and in addition to "decrement" the remaining size count for each musical sound to be generated. As is known in the art, there are many variations of "incrementing" or "changing" digital data such as that stored in RAM 12. For example, one skilled in the art could increment the address data stored in RAM 12 and decrement the size count in RAM 12 for each audio channel in a TDM format.

One skilled in the art could also merely complement the size count data so that the overall "increment" function is the same for both the address data and the size count data. It should be clear therefore that the term "increment" would include any logical variation for "changing" the digital data stored in RAM 12.

Latch 16 is provided to store the address data, which is 16-bits of digital data, for addressing ROM 20. The 16-bit data on memory address bus 22 is generated sequentially by the control means in a multi-channel TDM format for addressing the desired "sound data" ROM 20 as specified.

The overall control of the control means for addressing ROM 20 is desirably a micro-programmed processor contained within control circuit 18, the details of which will be described in conjunction with FIG. 3. Control circuit 18 provides appropriate signals to the control means via bus 26 in order to generate the TDM control signals on memory address bus 22 for connection to ROM 20. Control circuit 18 also provides control signals to bus 28 for connection to Level RAM 50 (to be described) and to DEMUX circuit 60.

Still referring to FIG. 1, the digital control signals on memory address bus 22 in effect address the "sound" digital data in the appropriate storage locations in ROM 20. As previously described, the digital data are read out of ROM 20 in a TDM format and are connected to 8-bit sound data bus 24 for connection to DAC circuit 30, which converts the TDM digital "sound data" to an analog format, corresponding to the TDM format specified via the control means previously described.

According to the present invention, the output of DAC circuit 30 could be connected to DEMUX circuit 60, which demultiplexes the TDM signals for connection to audio channels 62 which, in the preferred embodiment, would be eight audio channels for generating simultaneously up to eight musical sounds.

According to another aspect of the present invention, it is desirable to provide suitable adjustments to the intensity of the audio level generated on audio channels 62.

Accordingly, a "level" RAM 50 is provided which stores under control of a computer (not shown) via bus 8 appropriate digital control signals for adjusting the level of the appropriate musical sounds to be generated.

In FIG. 1, level RAM is shown connected to a multiplying digital to analog converter (MDAC) 40 via 8-bit bus 52. Level RAM 50 is controlled by control circuit 18 via bus 28 in order to adjust the particular audio channel. Level RAM 50 generates, in a TDM format, digital control signals on 8-bit bus 52 for connection to MDAC 40.

MDAC 40 receives the converted musical sounds from DAC 30 and will perform the appropriate multiplication, for each audio channel, of the analog audio signals with the respective adjustment level for each channel from level RAM 50.

The adjusted level signals from MDAC 40 for each audio channel are then connected to DEMUX circuit 60 which generates the adjusted audio level signals for each respective audio channel on bus 62.

Figure 2:
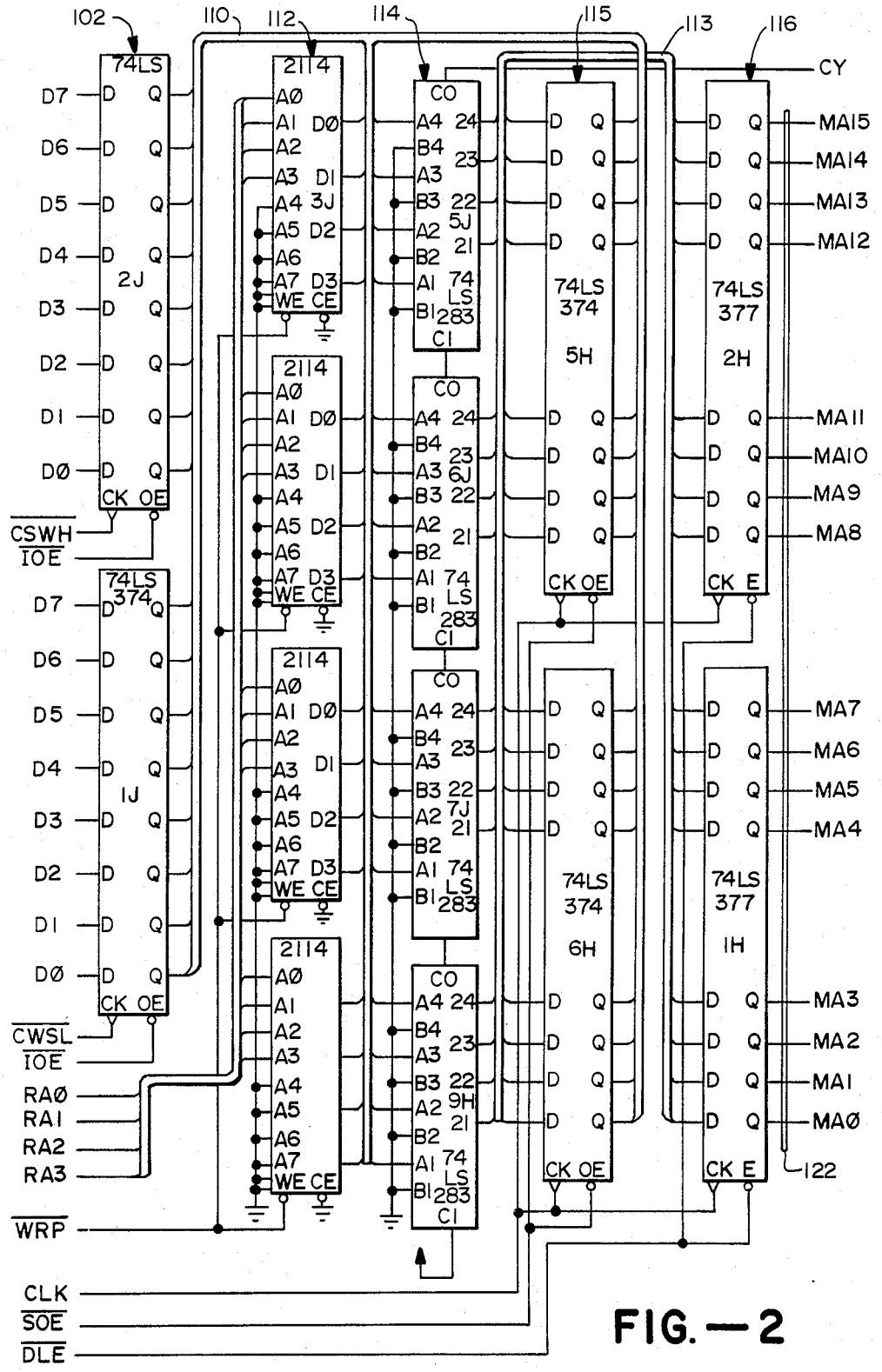
FIG. 2 depicts a schematic diagram which forms a portion of FIG. 1.

Referring now to FIG. 2, a schematic diagram of a portion of the control means of FIG. 1 is depicted in which a register file 112 corresponds to RAM 12 of FIG. 1. Register file 112 is typically a series of known register file circuits (such as type 2114 NMOS Static RAM) which form, in combination, a 16-bit by 16 word register file comprising the current address and remaining size count for each of the eight audio channels in the preferred embodiment.

The data input to register file 112 is provided, as previously described, from a computer (not shown) via digital data bus D0–D7 as illustrated in FIG. 2. The digital data is input to latches 102 (typically 74LS374) for connection to register file 112 via bus 110. Each latch 102 is clocked by a $\overline{\text{CSWH}}$ (chip select write high) or $\overline{\text{CSWL}}$ (low) signal and enabled by the $\overline{\text{IOE}}$ (input latch output enable) signal.

In FIG. 2, the incrementer 114 corresponds to incrementer 14 of FIG. 1 and is formed by circuits 74LS283 in combination. As previously described, the function of incrementer 114 in FIG. 2 is to increment or change the "count" in register file 112, for both the address of the current sound data to be addressed in ROM 20 of FIG. 1 and in addition the remaining size count for each audio channel. The CY (carry) signal is used to signal to the control circuit of FIG. 3 that the particular sound has been completed (the count has "decremented" to zero and a carry is generated).

In FIG. 2, sum latches 115 (formed by 74LS374 circuits) temporarily hold the data output of incrementer 114 from bus 113 for connection back to register file 112 via bus 110, thereby "changing" or "incrementing" the digital data stored in register file 112. Address latch 116 (formed by 74LS377) hold the final address computed for each channel and forms the memory address signals MA0–MA15 on bus 122, which corresponds to memory address bus 22 of FIG. 1.

Figure 3:
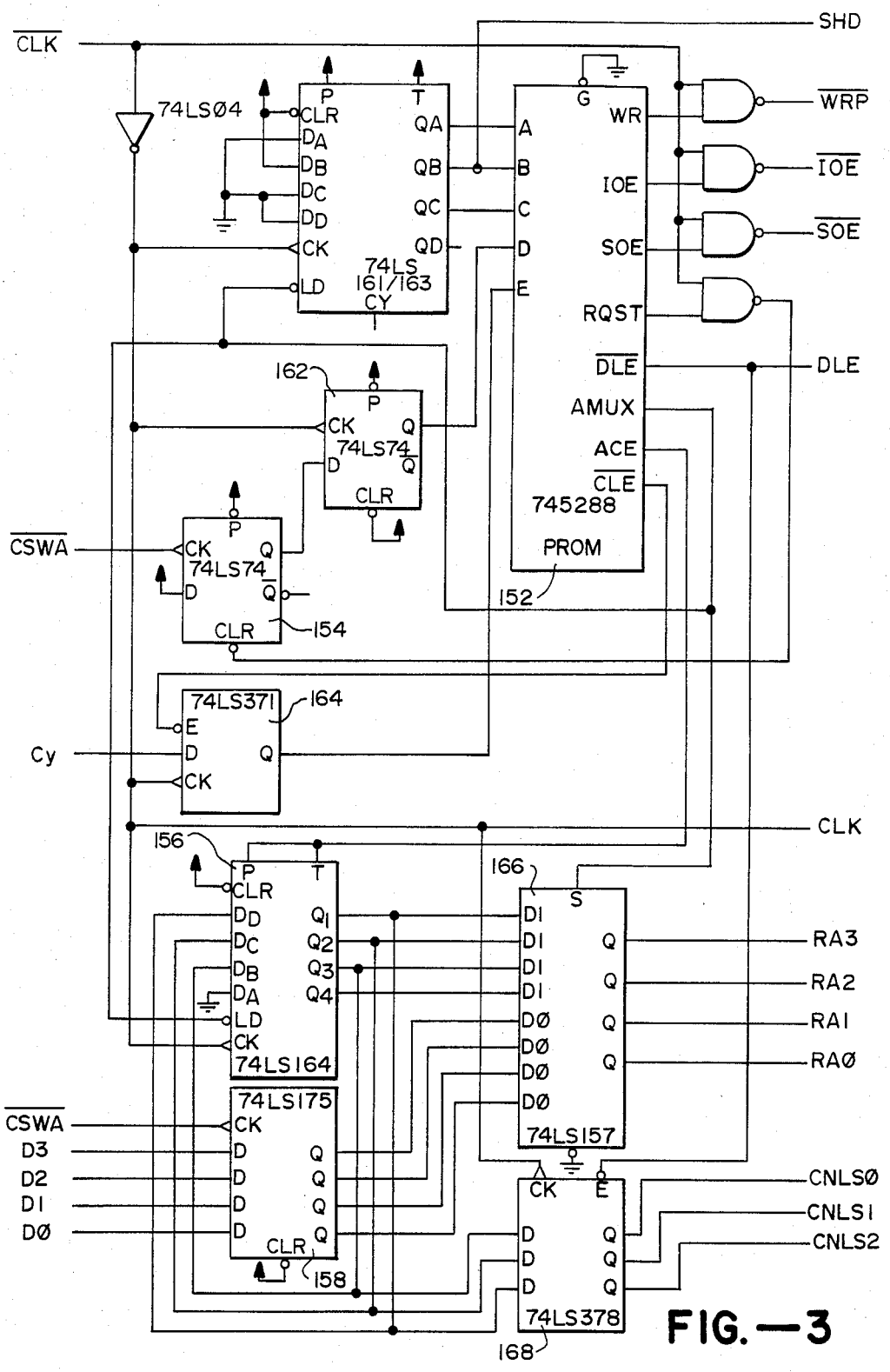
FIG. 3 depicts a more detailed portion of a control circuit which forms a portion of FIG. 1.

Referring now to FIG. 3, the control circuit 18 of FIG. 1 is shown in more detail. In FIG. 3, counter circuit 150 (typically 74LS161/163) counts, in the present embodiment, timing cycles of five states, which are interpreted by a microcode stored in PROM 152 (typically 74S288) into eight command signals which are identified as follows:

$\overline{WRP}$=write pulse
$\overline{IOE}$=input latch output enable
$\overline{SOE}$=sum latch output enable
RQRST=reset request latch 154
$\overline{DLE}$=data latch clock enable
AMUX=address multiplexer input select
ACE=address (channel) counter enable
$\overline{CLE}$=carry latch enable The microcode stored in PROM 152 is set forth in Appendix A, and forms part of the overall invention herein.

The $\overline{WRP}$ signal is connected to the Register File Circuits 112 of FIG. 2 and the $\overline{IOE}$ signal is the enable input to latches 102 of FIG. 2. The $\overline{SOE}$ signal is the enable signal for the Sum Latches 115 of FIG. 2 and the $\overline{DLE}$ signal is the address latch 116 enable signal of FIG. 2.

In FIG. 3, address counter 156 counts, in the preferred embodiment, the addresses of the eight channels for the eight musical sounds to be generated. Counter 156 is enabled by the ACE signal from PROM 152. Latch 158 (typically 74LS175) holds the address of a channel to be loaded by a computer (not shown) from input data D0–D3, as previously described.

In FIG. 3, selector circuit 166 (typically 74LS157) selects the data from address counter 156 or from channel address latch 158 for generating the signals RA0–RA3 (Register Address) for connection to the register file 112 of FIG. 2. The AMUX signal from PROM 152 controls selector 166.

As will be appreciated by one skilled in the art, for each audio channel to be generated, the invention operates in a microcycle for each particular cycle or audio channel.

Still referring to FIG. 3, latch 168 (typically 74LS378) provides stable channel select signals CNLS0-2 which are the three high order bits from address counter 156. The channel select signals are provided to the level RAM 50 and to the DEMUX circuit 60 of FIG. 1, and will be described in more detail below.

In a typical microcycle, the controller of FIG. 3 will increment the "size" of the count for each channel and test for a carry (CY signal) from latch 164.

If there is no carry (pin "E" of PROM 152), the incremented value is written back into register file 112 of FIG. 2. The address is then incremented and rewritten back into register file 112.

If there is a carry, there is no rewrite of data, but the current address is output to memory address bus 122 of FIG. 2.

The controller tests to see if there is a write request from the computer, and if so, write that data into the selected location in register file 112. This is controlled by the $\overline{CSWH}$ signal input buffered by latches 154 and 162, then presented to pin "D" of PROM 152.

Figure 4:
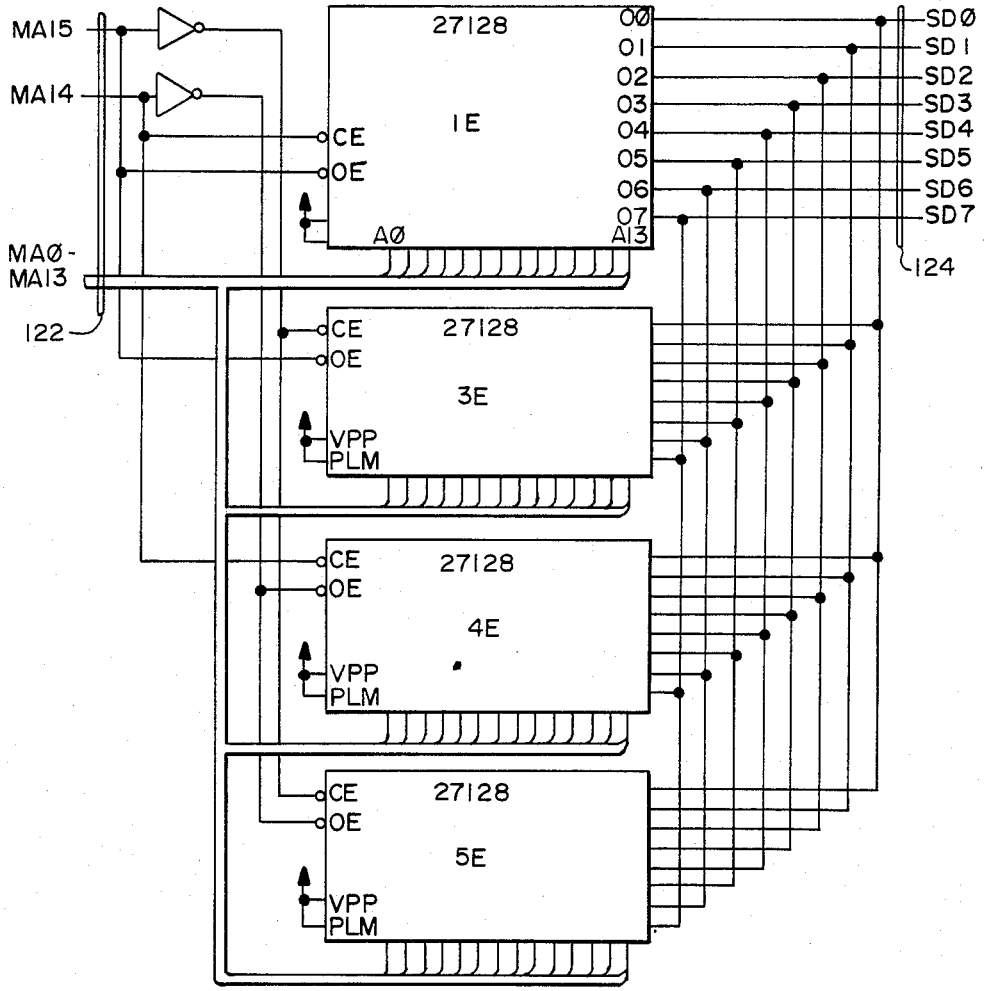
FIG. 4 depicts a schematic diagram of a sound ROM which forms a portion of FIG. 1.

Referring now to FIG. 4, the sound ROM 20 of FIG. 1 is depicted in schematic detail. Sound ROM 20 typically includes memory circuits (such as type 27128 16K×8 NMOS EPROM) which when addressed by memory address bus 122 will read out the desired data to sound data bus 124, which corresponds to 8-bit bus 24 of FIG. 1.

In a preferred embodiment, sound memory 20 is a 65K memory which stores a plurality of musical sounds in digital format and when addressed via memory bus 122 will generate in a multi-channel TDM format the musical sounds to be generated relatively simultaneously.

Figure 5:
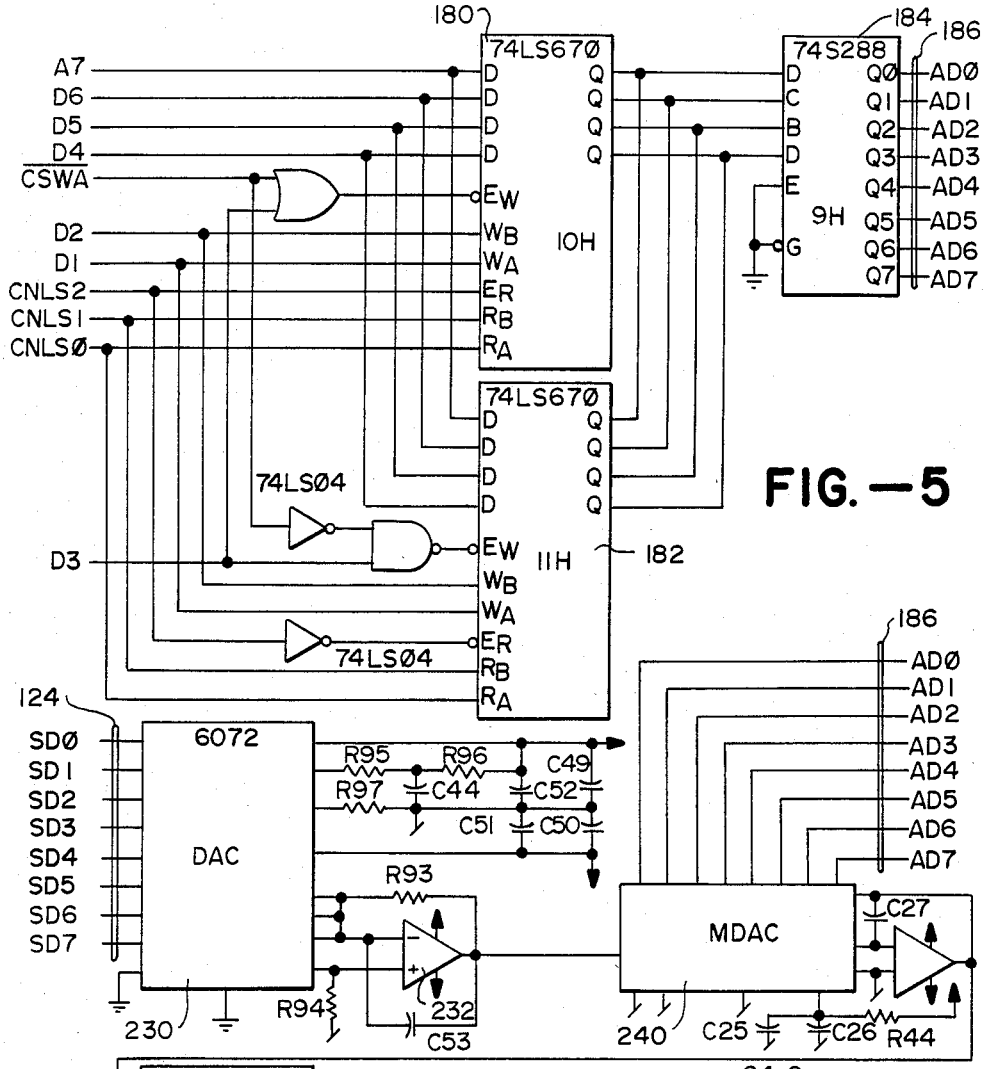
FIG. 5 depicts a more detailed diagram of a level random access memory which forms a portion of FIG. 1.

Referring now to FIG. 5, the level RAM 50 of FIG. 1 is shown in more detail. The level RAM 50 of FIG. 5 is a 4bit by 8 word simultaneous read-write memory. The four bits correspond to 16 levels in which the intensity of the audio sound for each channel is to be adjusted. The eight words correspond to the eight channels.

Level RAM 50 contains the audio level for each of the eight channels in a 4-bit code provided from a computer (not shown) via bus D4–D7.

Level RAM 50 in FIG. 5 includes register files (typically 74LS670) 180, 182 which receive the digital data from a computer via buses D4–D7. The appropriate control signals are provided via bus D1–D3 and the $\overline{CSWA}$ and CNLS0-2 control signals previously described.

Log PROM 184 (typically 74LS288) converts the 4-bit code from circuits 180, 182 into an 8-bit binary level on bus 186 (AD0–AD7), which corresponds to bus 52 of FIG. 1. If the response of level control is desired to be logarithmic, a log PROM 184 can be utilized. However, no PROM would be required for a linear response.

Appendix B illustrates the level code stored in PROM 184 for each of the eight channels in the preferred embodiment. PROM 184 converts the 4-bit code into an 8-bit binary level for connection to the multiplying DAC (MDAC) 40 of FIG. 1 during each channel's active time.

Figure 6:
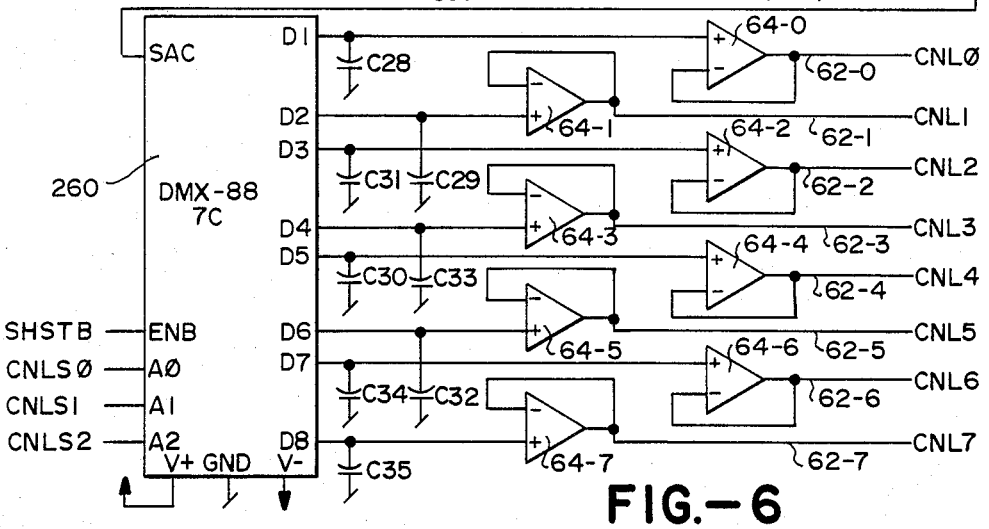
FIG. 6 depicts a more detailed diagram of a circuit for converting digital sound data to an audio format, which forms a portion of FIG. 1.

Referring now to FIG. 6, the sound data on bus 124 is connected to DAC circuit 230, which converts the digital sound data in TDM format to an audio format for connection to operational amplifier 232. DAC 230 converts the output of the sound data on bus 124 to a full level signal and the current signal is converted to a voltage signal via operational amplifier 232 for connection to MDAC 240.

The full level signal is then adjusted via the attenuation data signal on bus 186 according to the program code set forth in Appendix B. The adjusted analog TDM signal from MDAC 240 is then connected to DEMUX circuit 260 which corresponds to DEMUX 60 of FIG. 1.

DEMUX 260 distributes the adjusted audio signals for each channel to the appropriate audio channel 62-0 through 62-7 via amplifiers 64-0 to 64-7, respectively.

The musical sounds are thereby generated relatively simultaneously and it is clear that a plurality of sounds can be generated on audio channels 62-0 through 62-7 as depicted in FIG. 6 through a novel control means in such a manner as could be implemented by one skilled in the art in view of the foregoing specification. Moreover, more than one sound can be generated on each audio channel (e.g., twelve musical sounds on eight audio channels).

Other variations of the present invention are within the scope of the accompanying claims. For example, the adjustment by level RAM 50 of FIG. 1 could be achieved by interchanging DAC 30 and MDAC 40, depending on the particular application. The sound data from ROM 24 could thereby be adjusted digitally in MDAC 40 for connection to DAC 30 and hence to DEMUX 60.

Other variations of the present invention are of course possible and the subject matter of the present invention is only intended to be limited by the scope of the accompanying claims.

APPENDIX A

| ADDRESS | CODE (HEX) D7=MSB | COMMENTS |
|---|---|---|
| 00 | 0D | UNUSED: ALL FALSE |
| 01 | 0D | UNUSED: ALL FALSE |
| 02 | 0C | CARRY LATCH ENABLE |
| 03 | AF | SUM OUT ENABLE, WRITE, ADDRESS, COUNTER ENABLE |
| 04 | 05 | DATA LATCH ENABLE |
| 05 | AF | SUM OUT ENABLE, WRITE, ADDRESS COUNTER ENABLE |
| 06 | 09 | ADDRESS MUX TO INPUT |
| 07 | 0D | UNUSED: ALL FALSE |
| 08 | 0D | UNUSED: ALL FALSE |
| 09 | 0D | UNUSED: ALL FALSE |
| 0A | 0C | CARRY LATCH ENABLE |
| 0B | AF | SUM OUT ENABLE, WRITE, ADDRESS COUNTER ENABLE |
| 0C | 05 | DATA LATCH ENABLE |
| 0D | AF | SUM OUT ENABLE, WRITE, ADDRESS COUNTER ENABLE |
| 0E | D9 | INPUT LATCH ENB, WRITE, RESET RQ, ADDR MUX |
| 0F | 0D | UNUSED: ALL FALSE |
| 10 | 0D | UNUSED: ALL FALSE |
| 11 | 0D | UNUSED: ALL FALSE |
| 12 | 0C | CARRY LATCH ENABLE |
| 13 | 0F | ADDRESS COUNTER ENABLE |
| 14 | 05 | DATA LATCH ENABLE |
| 15 | 0F | ADDRESS COUNTER ENABLE |
| 16 | 09 | ADDRESS MUX |
| 17 | 0D | UNUSED: ALL FALSE |
| 18 | 0D | UNUSED: ALL FALSE |
| 19 | 0D | UNUSED: ALL FALSE |
| 1A | 0C | CARRY LATCH ENABLE |
| 1B | 0F | ADDRESS COUNTER ENABLE |
| 1C | 05 | DATA LATCH ENABLE |
| 1D | 0F | ADDRESS COUNTER ENABLE |
| 1E | D9 | INPUT LATCH ENB, WRITE, RESET, RQ. ADDR MUX |
| 1F | 0D | UNUSED: ALL FALSE |

APPENDIX B

| ADDRESS | CODE | COMMENT |
|---|---|---|
| 00 | 00 | off |
| 01 | 06 | −32.57 dB |

APPENDIX B-continued

| ADDRESS | CODE | COMMENT |
|---|---|---|
| 02 | 08 | −30.24 |
| 03 | 0A | −27.92 |
| 04 | 0D | −25.59 |
| 05 | 11 | −23.26 |
| 06 | 17 | −20.94 |
| 07 | 1E | −18.61 |
| 08 | 27 | −16.29 |
| 09 | 33 | −13.96 |
| 0A | 43 | −11.63 |
| 0B | 57 | −9.31 |
| 0C | 72 | −6.98 |
| 0D | 95 | −4.65 |
| 0E | C3 | −2.33 |
| 0F | FF | 0.00 |
| 10 | 00 | UNUSED |
| 11 | 00 | |
| 12 | 00 | |
| 13 | 00 | |
| 14 | 00 | |
| 15 | 00 | |
| 16 | 00 | |
| 17 | 00 | |
| 18 | 00 | |
| 19 | 00 | |
| 1A | 00 | |
| 1B | 00 | |
| 1C | 00 | |
| 1D | 00 | |
| 1E | 00 | |
| 1F | 00 | |

What is claimed is:

1. An electronic musical instrument comprising a sound data bus, first memory means for storing digital data representing one or more musical sounds where specified words of said digital data are allocated to respective storage locations in said first memory means in order to represent a respective musical sound when said respective digital words are read out of said respective storage locations in a multi-channel time division multiplex format to said sound data bus, a memory address bus, control means for addressing said first memory means via said memory address bus for reading said digital data to said sound data bus in said time division multiplex format, said addressing means including second memory means having a first location for storing first digital control words specifying the current address for each channel in said time division multiplex format of said digital data words to be addressed, and a second location for storing second digital control words specifying the number of digital data words to be addressed for each channel in said first memory means in order to complete the musical sound to be generated, digital to analog converter means for converting the digital data representing said one or more musical sounds on said sound data bus to an analog format, and demultiplexer means for demultiplexing the multiplexed analog data to analog audio channels corresponding to said one or more musical sounds.

2. An electronic musical instrument comprising first memory means for storing digital data representing one or more musical sounds where specified words of said digital data are allocated to respective storage locations in said first memory means in order to represent the respective musical sound when said respective digital words are read out of said respective storage locations in a multi-channel time division multiplex format, and control means for addressing first memory means for reading said digital data from said respective storage locations in said time division multiplex format, said control means including second memory means having first storage locations for storing first digital control words specifying the current address for each channel in said time division multiplex format to be addressed and second storage locations for storing second digital control words for specifying the remaining number of digital data words to be addressed for each channel in said first memory means in order to complete the musical sound to be generated.

3. An electronic musical instrument as in claim 2 further including third memory means for storing third digital control words representing volume level adjustments of said one or more musical sounds in said multi-channel time division multiplex format and multiplying digital to analog converter means for multiplying said adjustable control words with corresponding ones of said converted analog words thereby adjusting the level of said converted analog signals.

4. An electronic musical instrument as in claim 2 wherein said second memory means include a random access memory for storing said first and second digital control words and means for incrementing during each cycle of said time division multiplex format said digital data words in said random access memory means.

5. An electronic musical instrument as in claim 2 wherein said control means include means for storing a series of programmed instructions for controlling the operation of said first memory means.

* * * * *